US008029299B1

(12) United States Patent
Huang

(10) Patent No.: US 8,029,299 B1
(45) Date of Patent: Oct. 4, 2011

(54) COVER UNIT

(75) Inventor: Joseph Huang, Taoyuan (TW)

(73) Assignee: Ho E Screw & Hardware Co., Ltd., Taoyuan (TW)

( * ) Notice: Subject to any disclaimer, the term of this patent is extended or adjusted under 35 U.S.C. 154(b) by 0 days.

(21) Appl. No.: 12/913,853

(22) Filed: Oct. 28, 2010

(51) Int. Cl.
*H01R 13/44* (2006.01)

(52) U.S. Cl. ..... 439/135

(58) Field of Classification Search ..... 439/135, 439/148, 353, 358, 372, 198
See application file for complete search history.

(56) References Cited

U.S. PATENT DOCUMENTS

| | | | | |
|---|---|---|---|---|
| 6,999,322 | B1 * | 2/2006 | Lin | 361/752 |
| 7,241,153 | B2 * | 7/2007 | He et al. | 439/148 |
| 7,341,464 | B2 * | 3/2008 | Cuellar et al. | 439/135 |
| 7,503,780 | B1 * | 3/2009 | Huang | 439/135 |
| 7,547,218 | B2 * | 6/2009 | Hiew et al. | 439/135 |
| 7,568,942 | B1 * | 8/2009 | Lannon et al. | 439/521 |
| 7,946,891 | B2 * | 5/2011 | Peiker | 439/638 |
| 2006/0023433 | A1 * | 2/2006 | Lin | 361/752 |
| 2006/0234533 | A1 * | 10/2006 | Lei et al. | 439/135 |
| 2010/0151712 | A1 * | 6/2010 | Chang | 439/135 |
| 2010/0290180 | A1 * | 11/2010 | Huang | 361/679.32 |
| 2010/0290181 | A1 * | 11/2010 | Huang | 361/679.32 |
| 2010/0321878 | A1 * | 12/2010 | Huang | 361/679.31 |

FOREIGN PATENT DOCUMENTS

| | | |
|---|---|---|
| TW | M356200 | 5/2009 |

* cited by examiner

*Primary Examiner* — Tulsidas C Patel
*Assistant Examiner* — Vladimir Imas
(74) *Attorney, Agent, or Firm* — Guice Patents PLLC

(57) ABSTRACT

A cover unit for a USB flash disk, wherein a seat hole is provided at the middle position of a seat, an engaging structure with an elastic element is pivotally provided in the cover unit to provide restoring force, an engaging plate of the engaging structure can be extended into the opening of the USB connector, and by using protruding blocks provided on the engaging plate in matching with directional holes on the USB connector, the holes are covered by the blocks to seal the USB connector; meantime when a stopping plate on the engaging plate is pressed, engaging of the protruding blocks with the directional holes can be relieved, thereby the whole cover unit can be removed.

11 Claims, 7 Drawing Sheets

COVER UNIT

BACKGROUND OF THE INVENTION

1. Field of the Invention

The present invention relates to a cover unit, and especially to a cover unit used for sealing an opening of a USB socket of a USB flash disk.

2. Description of the Prior Art

A USB flash disk is a mobile storage device, its capacity is much larger than a compact disk (CD) now after fast progression, and is convenient for carrying, it is used very widely.

A USB flash disk is provided with a protruding USB jack, it is provided thereon with an opening being subjected to getting entering of impurity or small materials, the opening with a USB connector must be sealed with a cover provided over the USB jack.

In the prior art, a Utility model application with a publication No. M356200 titled "USB FLASH DISK WITH A NON-TOUCHING SENSING CHIP" in Taiwan discloses a design of the above mentioned cover. Wherein the cover is integrally injection shaped, if it is desired to firmly cover, the internal tolerance of the cover must be made to tightly match the USB connector, this renders the cover to need larger force to overcome the impedance coming from tightness against slipping over and extracting. And more, a conventional tightly matching type cover not only needs larger force for slipping over and extracting, it also has a defect of being unable to tightly cover being due to suffering of the cover from pressing that induce damage or due to damage by friction in a long term using; therefore improvement is needed.

SUMMARY OF THE INVENTION

In view of the above defects, the cover unit for a USB flash disk has a seat hole provided at the middle position of a seat, an engaging structure with an elastic element is pivotally provided in the cover unit to provide restoring force, an engaging plate of the engaging structure can be extended into the opening of the USB connector, and by using protruding blocks provided on the engaging plate in matching with directional holes on the USB connector, the holes are covered by the blocks to seal the USB connector; meantime a stopping plate on the engaging plate is pressed, engaging of the protruding blocks with the directional holes can be relieved, thereby the whole cover unit can be removed.

The cover unit for the USB flash disk of the present invention can prevent the cover unit from the defect of loosening and dropping by covering of the protruding blocks over the directional holes, hence the USB connector can be completely sealed to get a better protecting effect.

The present invention will be apparent in its structural feature and effect in use after reading the detailed description of the preferred embodiment thereof in reference to the accompanying drawings.

DETAILED DESCRIPTION OF THE PREFERRED EMBODIMENT

Figures 1, 1A:
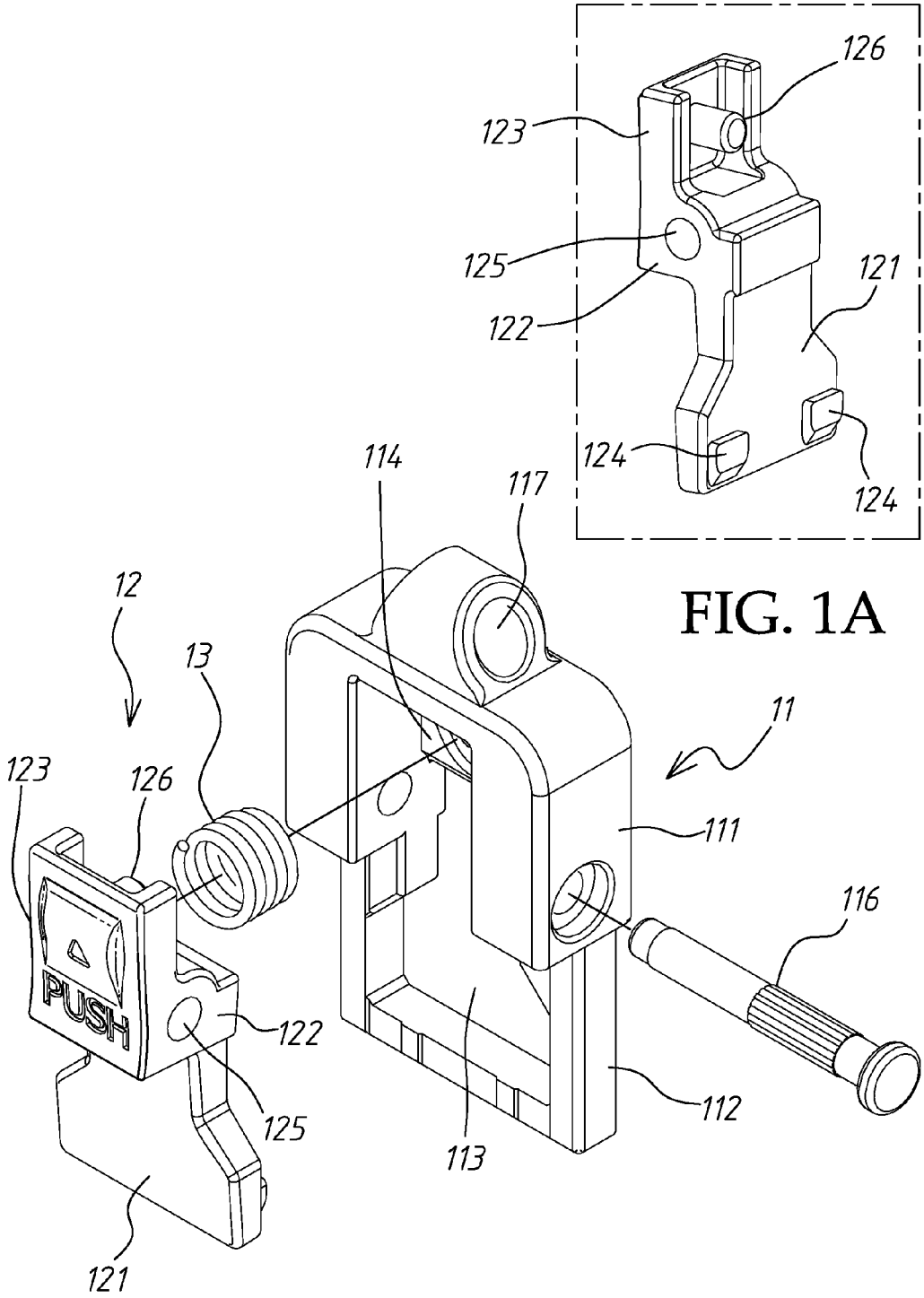
FIG. 1 is an anatomic perspective view showing a first embodiment of the present invention.
FIG. 1A is a perspective view showing an engaging structure of the first embodiment of the present invention viewing from another direction.
Figure 2:
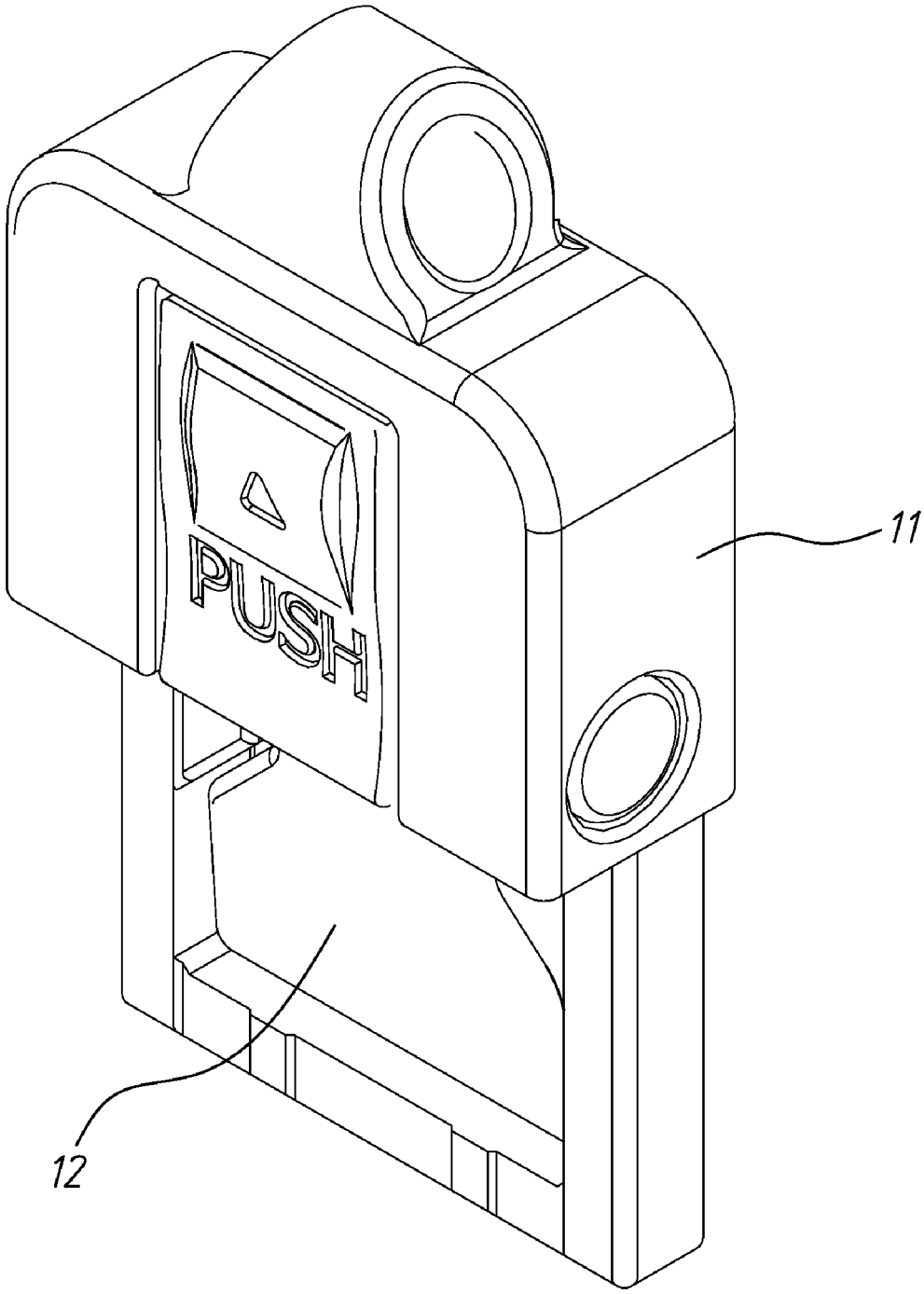
FIG. 2 is a perspective view showing a figure of the assembled unit of the first embodiment of the present invention.
Figure 3:
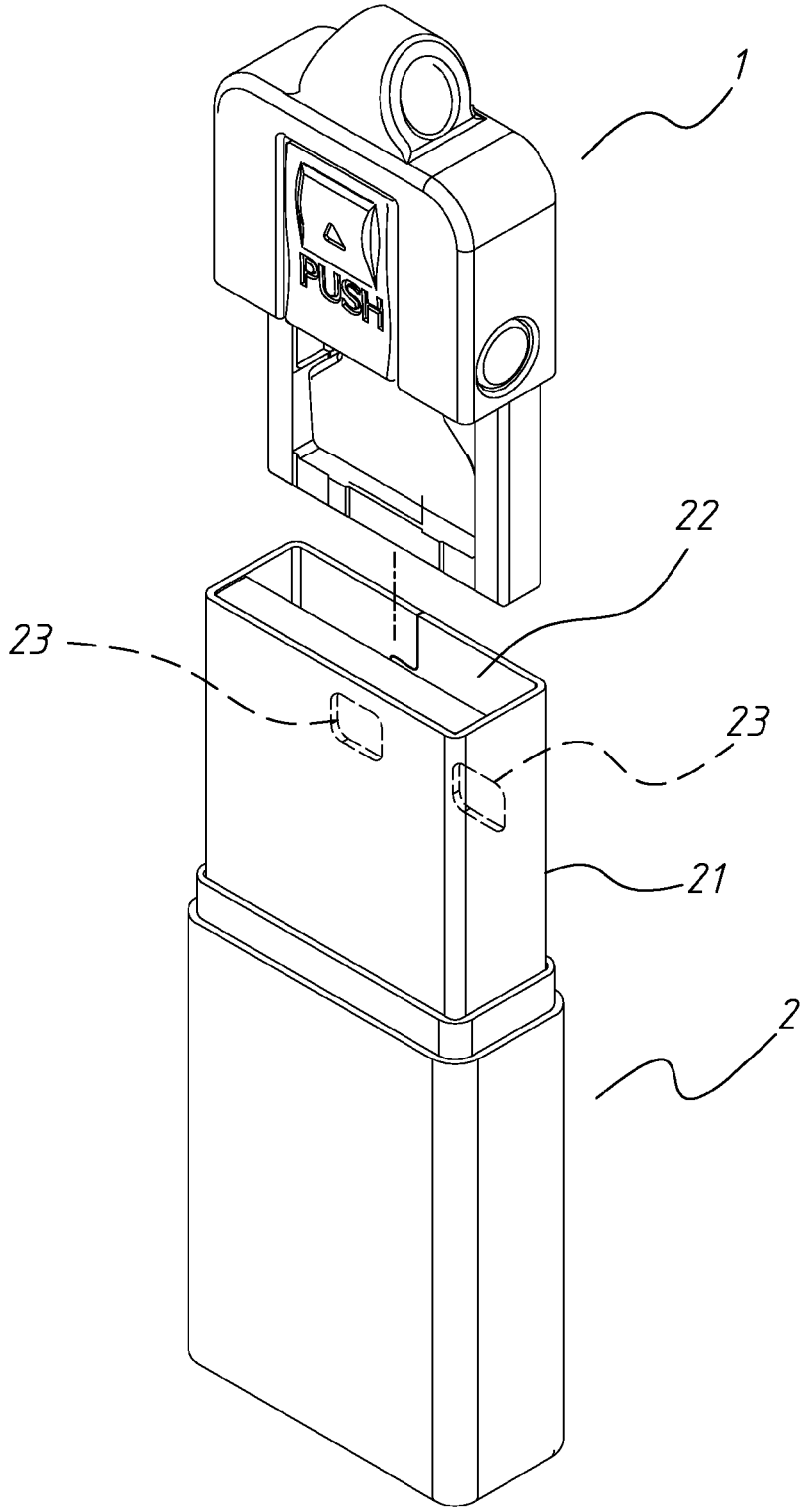
FIG. 3 is an anatomic perspective view showing the first embodiment of the present invention being used on a USB flash disk.
Figure 4:
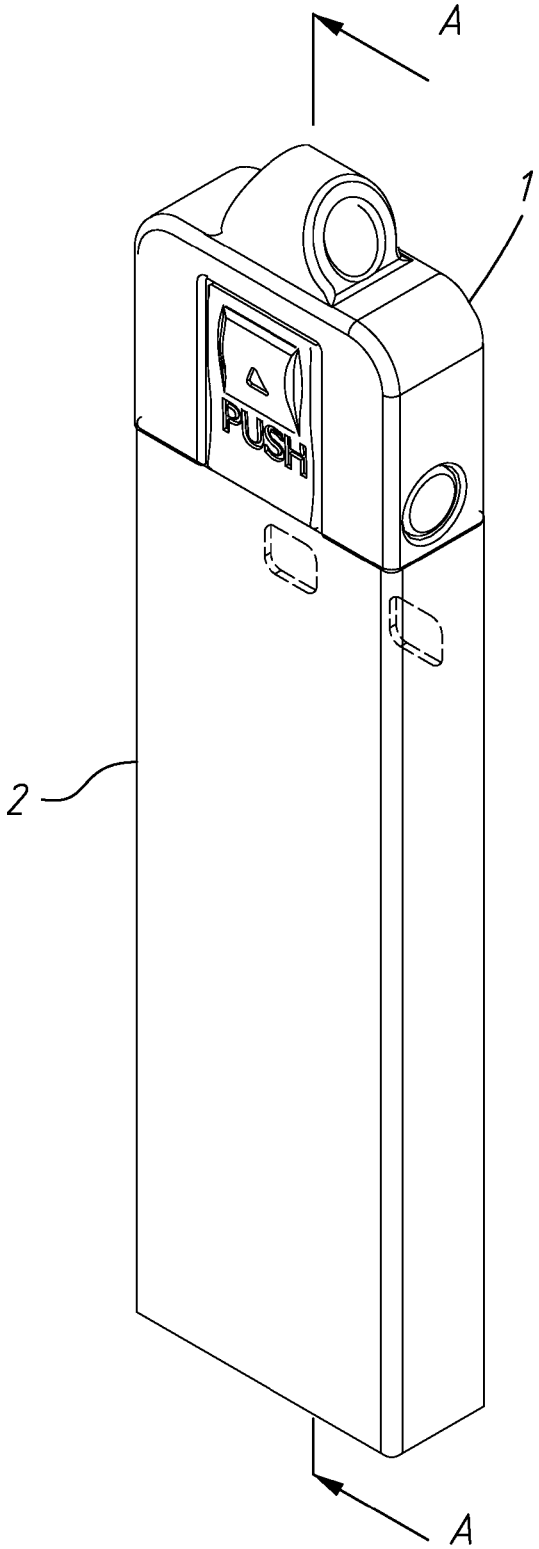
FIGS. 4 and 5 are perspective views respectively showing the assembled unit of the first embodiment of the present invention in different viewing angular positions.

Referring to FIGS. 1 and 2 showing the first embodiment of the present invention which is a cover unit 1 of a USB flash disk 2 for sealing an opening 22 of a USB connector 21 of the USB flash disk 2 (as shown in FIG. 3). The present invention mainly comprises a seat 11, an engaging structure 12 and an elastic element 13.

The seat 11 has a thicker portion 111 and an insertion portion 112. The thicker portion 111 has a sectional area larger than that of the opening 22 of the USB connector 21, while the insertion portion 112 is smaller than the opening 22 of the USB connector 21 to allow insertion of itself, the seat 11 is provided at its middle with a seating hole 113. The seating hole 113 of the seat 11 is provided therein with a sealing plate 114 which is formed thereon a second positioning post 115 (referring to FIG. 6). The thicker portion 111 of the seat 11 is provided thereon with a pivot axle 116 extending from outside into the hole 113. The top of the seat 11 is formed to have a looped seat 117 for the convenience of connecting a ring or some other linear material.

Figure 5:
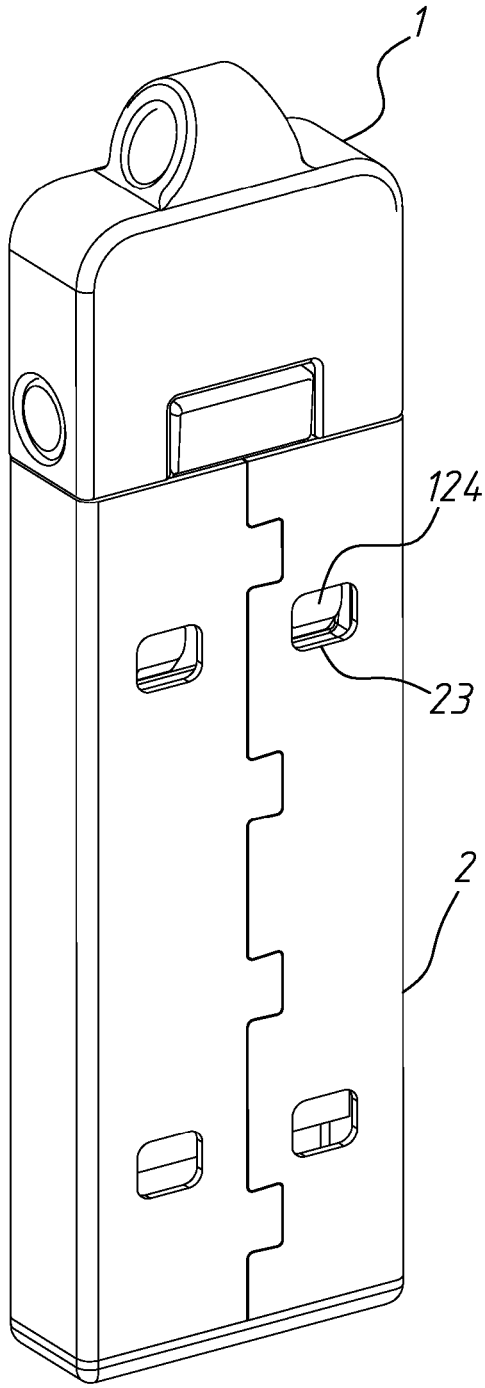
Figure 6:
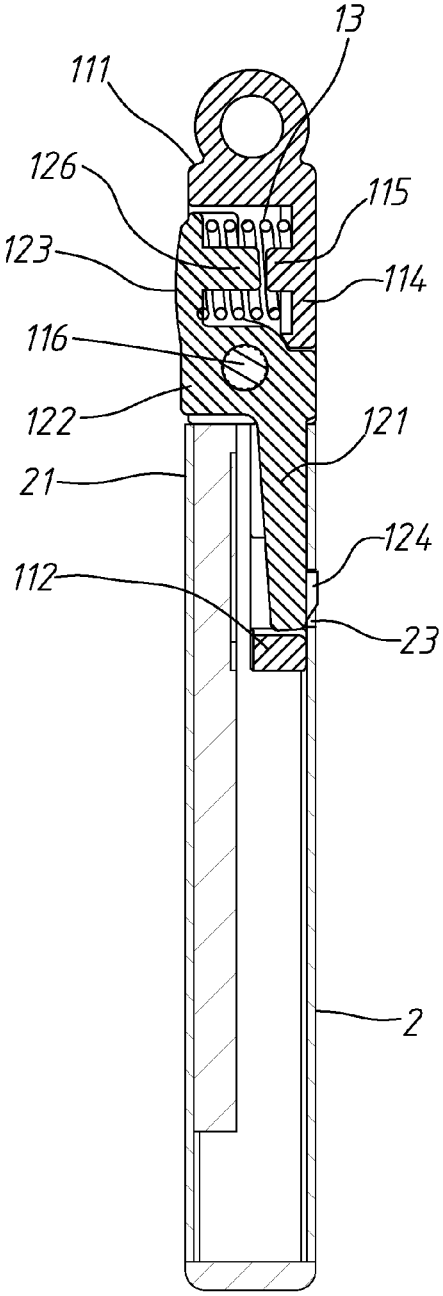
FIG. 6 is a sectional view taken from the line A-A in FIG. 4.

The engaging structure 12 is pivotally connected in the seating hole 113 and has an engaging plate 121, a pivot portion 122 and a stop plate 123. The engaging plate 121 is provided in the insertion portion 112 to be inserted together with the insertion portion 112 into the opening 22 of the USB connector 21, such as is shown in FIGS. 5, 6, and the engaging plate 121 is shaped to have a pair of protruding blocks 124 (as shown in FIG. 1A) at two positions in corresponding to where two directional holes 23 on the USB connector 21 are, in order to be engaged in the directional holes 23. The stop plate 123 is a hollow frame and is provided in the thicker portion 111. The pivot portion 122 is provided between the engaging plate 121 and the stop plate 123, and is pivotally connected with the seat 11, the pivot axle 116 is extended from outside of the thicker portion 111 into and through an axle hole 125 of the pivot portion 122. When the stop plate 123 is pressed, the engaging structure 12 will rotate about the pivot axle 116 of the pivot portion 122, so that engagement of the protruding blocks 124 with the directional holes 23 is relieved, thus the entire cover unit 1 can be separated from the USB connector 21 such as is shown in FIG. 7.

The elastic element 13 is provided between the engaging structure 12 and the seat 11 for providing the engaging structure 12 with restoring force, for the purpose of keeping the protruding blocks 124 to be engaged in the directional holes 23 such as are shown in FIGS. 5, 6. By the fact that the stop plate 123 is a hollow frame, the interior of it is for accommodating the elastic element 13, and the sealing plate 114 of the seat 11 envelops the elastic element 13 together with the stop plate 123.

More over, the elastic element 13 can be a spring, and the stop plate 123 (the hollow frame) is provided therein with a first positioning post 126, the sealing plate 114 is formed thereon a second positioning post 115 (referring to FIG. 6 or 7) in order to set the spring on the first and the second positioning posts 126, 115.

Figure 7:
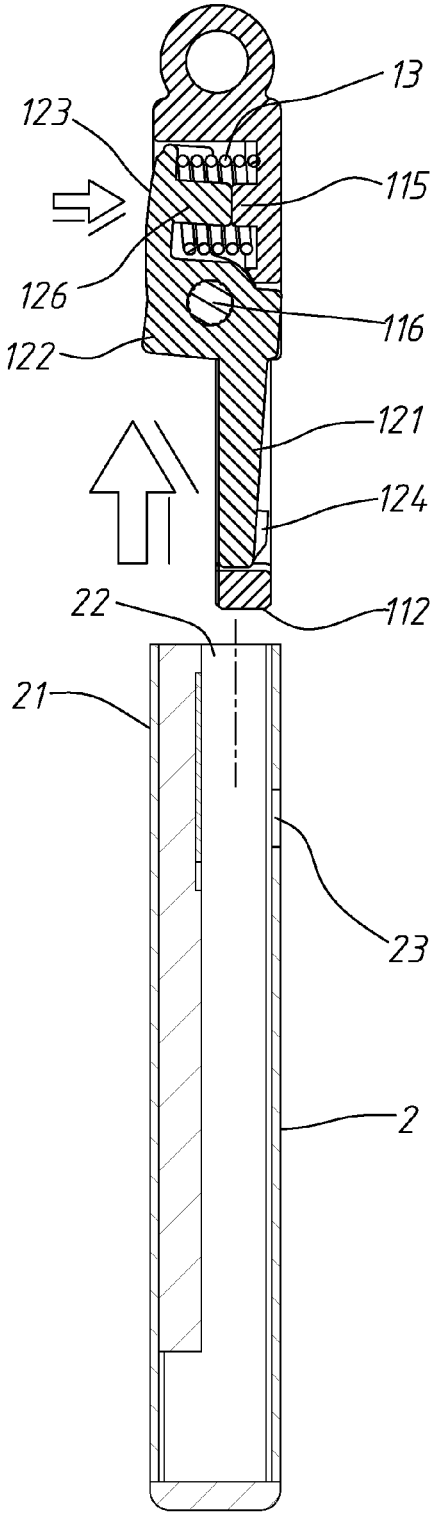
FIG. 7 is a schematic sectional view showing actions in FIG. 6.

Please refer to FIGS. 6, 7 to see the operation of the present invention; in a normal time, the insertion portion 112 of the cover unit 1 and the engaging plate 121 are inserted into the opening 22 of the USB connector 21, as shown in FIG. 6, the upper portion of thicker portion 111 is used to seal the opening 22. When the stop plate 123 is pressed, engagement of the protruding blocks 124 with the directional holes 23 is relieved, so that the entire cover unit 1 can be separated by extracting from the USB connector 21 such as is shown in FIG. 7, in order that the USB connector 21 can be connected to a computer for use.

The cover unit 1 provided in the present invention will not have a defect of loosening because the protruding blocks 124 of the engaging structure 12 is engaged in the directional holes 23, and can surely completely seal the USB connector 21 to get a better protecting effect.

Figure 8A:
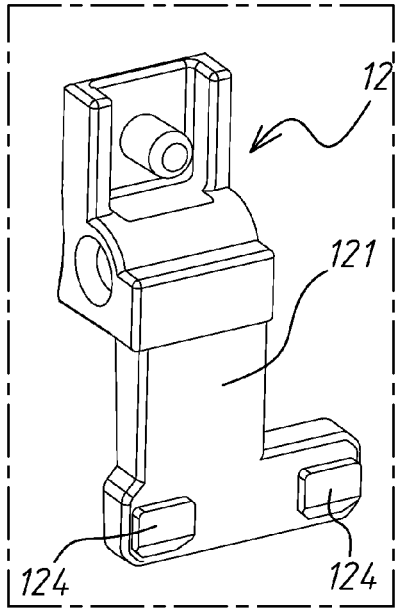
FIG. 8A is a perspective view showing an engaging structure of FIG. 8 viewing from another direction.
Figure 8:
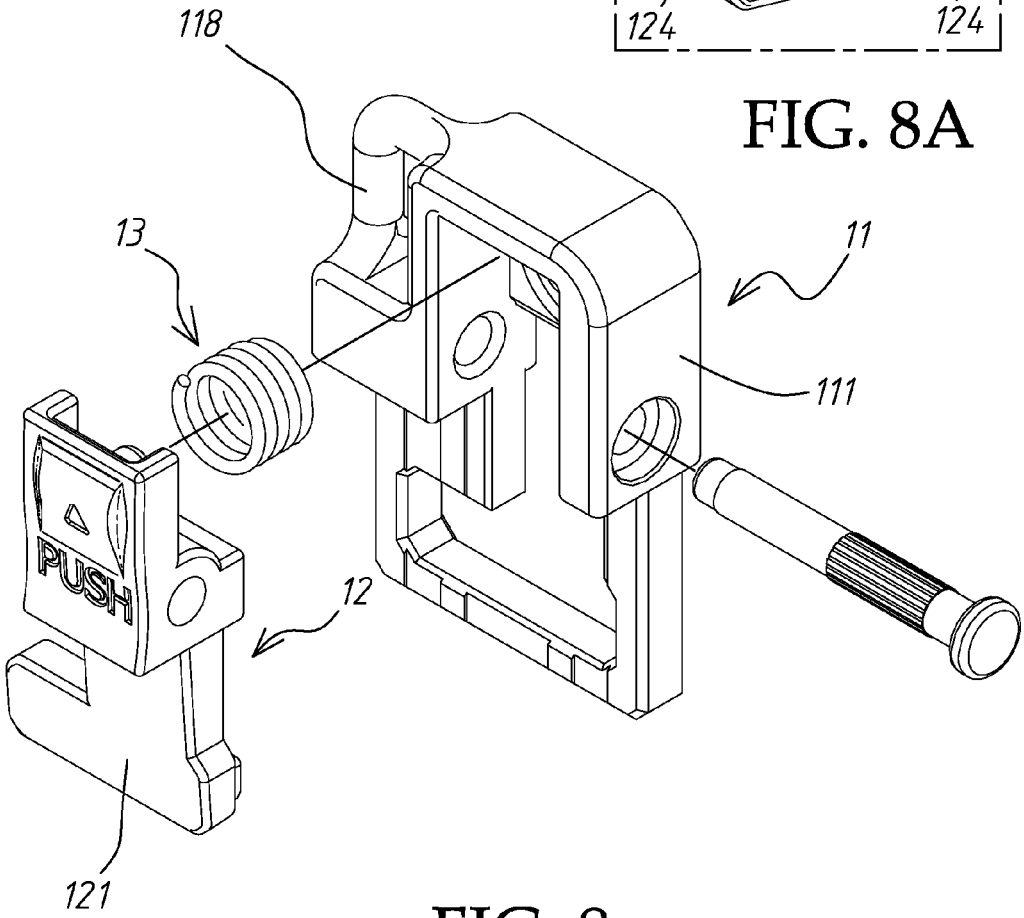
FIG. 8 is an anatomic perspective view showing a second embodiment of the present invention.

Moreover, FIG. 8 shows the second embodiment of the present invention, this embodiment is generally identical to the first embodiment stated above, but it has a looped seat 118 on one side of the seat 11. The engaging plate 121 of the engaging structure 12 is in a shape of "L" to be accommodated in the thicker portion 111 of the seat 11. Referring to FIG. 8, the protruding blocks 124 is provided on a longer leg of the engaging plate 121.

Figures 9, 9A:
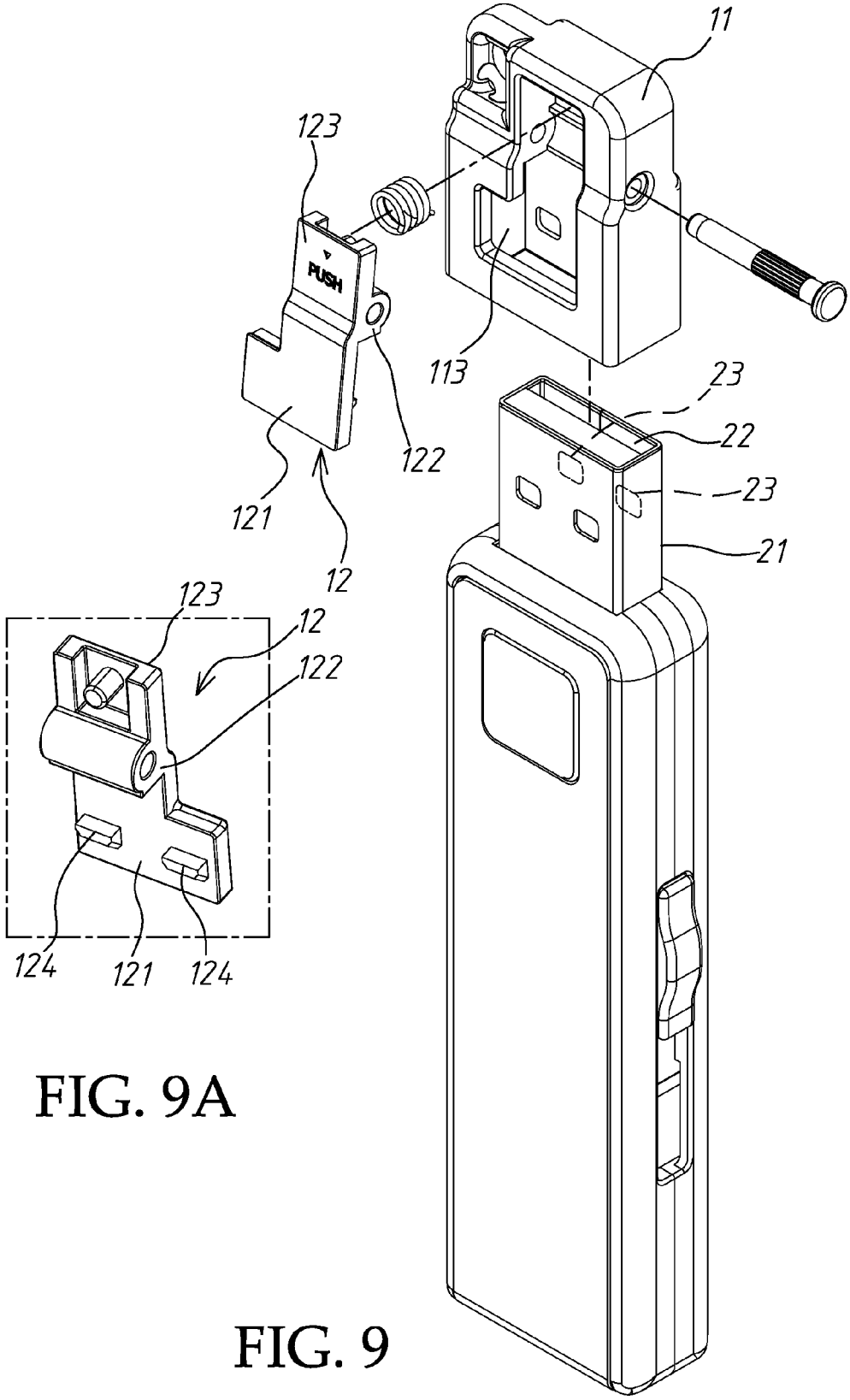
FIG. 9 is an anatomic perspective view showing a third embodiment of the present invention.
FIG. 9A is a perspective view showing an engaging structure of FIG. 9 viewing from another direction.

Referring to FIG. 9, it shows the third embodiment of the present invention, this embodiment is generally similar to the second embodiment, but the seat 11 covers over the USB connector 21, and is formed to have at its middle area a seating hole 113.

The engaging structure 12 is pivotally connected in the seating hole 113 and has an engaging plate 121, a pivot portion 122 and a stop plate 123. The engaging plate 121 can be inserted into an opening 22 of the USB connector 21, and the engaging plate 121 is shaped to have a pair of protruding blocks 124 (as shown in FIG. 9A) at two positions in corresponding to where two directional holes 23 on the USB connector 21 are, in order to be engaged in the directional holes 23. The stop plate 123 is provided relatively above the USB connector 21. The pivot portion 122 is provided between the engaging plate 121 and the stop plate 123, and is pivotally connected with the seat 11, When the stop plate 123 is pressed, the engaging structure 12 will rotate about a pivot connecting area of the pivot portion 122, so that engagement of the protruding blocks 124 with the directional holes 23 is relieved, this is identical to the second embodiment. An elastic element 13 is also same as that of the second embodiment. Other specific contents can also be referred to those of the second embodiment.

In conclusion, the cover unit of the USB flash disk of the present invention can reduce damaging of its corners; therefore, the present invention completely meets the requirement of patentable elements, and what we claim will be declared in the claims followed.

The invention claimed is:

1. A cover unit for a USB flash disk used for sealing an opening of a USB socket of said USB flash disk, comprising:

a seat having a thicker portion and an insertion portion, said thicker portion having a sectional area larger than that of said opening of said USB connector, while said insertion portion being smaller than said opening of said USB connector to allow insertion of itself, said seat being provided at its middle with a seating hole;

an engaging structure being pivotally connected in said seating hole and having at least an engaging plate, a pivot portion and a stop plate; said engaging plate being provided in said insertion portion to be inserted together with said insertion portion into said opening of said USB connector, and said engaging plate being shaped to have a pair of protruding blocks at two positions in corresponding to where two directional holes on said USB connector are, in order to be engaged in said directional holes; said stop plate being provided in said thicker portion; said pivot portion being provided between said engaging plate and said stop plate, when said stop plate being pressed, said engaging structure rotating about a pivotally connecting position of said pivot portion, so that engagement of said protruding blocks with said directional holes are relieved, and an elastic element being provided between said engaging structure and said seat for providing said engaging structure with restoring force, for keeping said protruding blocks of said engaging plate to be engaged in said directional holes.

2. A cover unit for a USB flash disk as claimed in claim 1, wherein, said stop plate is a hollow frame, its interior is for accommodating said elastic element, said seating hole of said seat is provided therein with a sealing plate, said sealing plate envelops said elastic element together with said stop plate.

3. A cover unit for a USB flash disk as claimed in claim 1, wherein, said elastic element is a spring, and said stop plate (said hollow frame) is provided therein with a first positioning post, said sealing plate is formed thereon a second positioning post in order to set said spring on said first and said second positioning posts.

4. A cover unit for a USB flash disk as claimed in claim 2, wherein, said thicker portion of said seat is provided thereon with a pivot axle extending from outside into and through an axle hole of said pivot portion of said engaging structure.

5. A cover unit for a USB flash disk as claimed in claim 4, wherein, said seat is formed on its top a looped seat.

6. A cover unit for a USB flash disk as claimed in claim 4, wherein, a looped seat is formed on one side of said seat, said engaging plate of said engaging structure is in a shape of "L".

7. A cover unit for a USB flash disk used for sealing an opening of a USB socket of said USB flash disk, comprising:

a seat enveloping said USB connector, said seat being provided at its middle with a seating hole;

an engaging structure being pivotally connected in said seating hole and having at least an engaging plate, a pivot portion and a stop plate; said engaging plate being inserted into an opening of said USB connector, and said engaging plate being shaped to have a pair of protruding blocks at two positions in corresponding to where two directional holes on said USB connector are, in order to be engaged in said directional holes; said pivot portion being provided between said engaging plate and said stop plate, and being pivotally connected with said seat; when said stop plate being pressed, said engaging structure rotating about a pivotally connecting position of said pivot portion, so that engagement of said protruding blocks with said directional holes are relieved; and an elastic element being provided between said engaging structure and said seat for providing said engaging structure with restoring force, for keeping said protruding blocks of said engaging plate to be engaged in said directional holes.

8. A cover unit for a USB flash disk as claimed in claim 7, wherein, said stop plate is a hollow frame, its interior is for accommodating said elastic element, said seating hole of said seat is provided therein with a sealing plate, said sealing plate envelops said elastic element together with said stop plate.

9. A cover unit for a USB flash disk as claimed in claim 8, wherein, said elastic element is a spring, and said stop plate (said hollow frame) is provided therein with a first positioning post, said sealing plate is formed thereon a second positioning post in order to set said spring on said first and said second positioning posts.

10. A cover unit for a USB flash disk as claimed in claim 9, wherein, said seat is provided thereon with a pivot axle extending from outside into and through an axle hole of said pivot portion of said engaging structure.

11. A cover unit for a USB flash disk as claimed in claim 10, wherein, a looped seat is formed on one side of said seat, said engaging plate of said engaging structure is in a shape of "L".

* * * * *